United States Patent [19]

Wilhelm et al.

[11] Patent Number: 4,658,727

[45] Date of Patent: Apr. 21, 1987

[54] SELECTABLE INITIATION-POINT FRAGMENT WARHEAD

[75] Inventors: Earl E. Wilhelm; Alan B. Zimmerschied, both of Renton, Wash.

[73] Assignee: The Boeing Company, Seattle, Wash.

[21] Appl. No.: 655,703

[22] Filed: Sep. 28, 1984

[51] Int. Cl.[4] ..... F42B 13/18

[52] U.S. Cl. ..... 102/494; 102/492

[58] Field of Search ..... 102/490–495, 102/478, 479, 499, 309

[56] References Cited

U.S. PATENT DOCUMENTS

| | | | |
|---|---|---|---|
| 96,595 | 11/1869 | Jobson | 102/495 |
| 382,225 | 5/1888 | Graydon | 102/478 |
| 1,300,333 | 4/1919 | Berry | 102/493 |
| 2,376,227 | 5/1945 | Brown | 102/5 |
| 2,457,817 | 1/1949 | Harrell | 102/389 |
| 2,775,940 | 1/1957 | Klotz, Jr. | 102/23 |
| 2,831,429 | 4/1958 | Moore | 102/20 |
| 2,977,885 | 4/1961 | Perry, Jr. et al. | 102/98 |
| 3,145,656 | 8/1964 | Cook et al. | 102/24 |
| 3,163,113 | 12/1964 | Davis et al. | 102/98 |
| 3,218,976 | 11/1965 | Nooker | 102/58 |
| 3,224,372 | 12/1965 | Nooker | 102/67 |
| 3,245,353 | 4/1966 | Gilbertson | 102/70.2 |
| 3,326,125 | 6/1966 | Silvia et al. | 102/22 |
| 3,344,744 | 10/1967 | Bankston | 102/28 |
| 3,358,780 | 12/1967 | Venghiattis | 175/4.5 |
| 3,447,416 | 6/1969 | Apstein | 86/1 |
| 3,447,463 | 6/1969 | Lavine | 102/67 |
| 3,457,859 | 7/1969 | Guenter | 102/22 |
| 3,598,051 | 8/1971 | Avery | 102/23 |
| 3,651,760 | 3/1972 | Held | 102/70.2 A |
| 3,677,183 | 7/1972 | Talley | 102/67 |
| 3,703,865 | 11/1972 | Gilbertson et al. | 102/56 |
| 3,714,897 | 2/1973 | Parker | 102/56 |
| 3,720,168 | 3/1973 | Sylwester | 102/67 |
| 3,726,223 | 4/1973 | Moe | 102/72 |
| 3,796,158 | 3/1974 | Conger | 102/67 |
| 3,820,461 | 6/1974 | Silvia | 102/23 |
| 3,853,059 | 12/1974 | Moe | 102/67 |
| 3,877,376 | 4/1975 | Kupelian | 102/67 |
| 3,960,085 | 6/1976 | Abernathy et al. | 102/67 |
| 3,977,327 | 8/1976 | Brumfield et al. | 102/67 |
| 3,978,796 | 9/1976 | Hackman | 102/67 |
| 4,026,213 | 5/1977 | Kempton | 102/492 |
| 4,080,900 | 3/1978 | Augenstein | 102/67 |
| 4,091,870 | 5/1978 | Godfrey et al. | 166/299 |
| 4,106,410 | 8/1978 | Borcher et al. | 102/67 |
| 4,211,169 | 7/1980 | Brothers | 102/494 |
| 4,312,274 | 1/1982 | Zernow | 102/493 |
| 4,334,474 | 6/1982 | Coltharp | 102/206 |
| 4,381,692 | 5/1983 | Weintraub | 29/1.2 |

FOREIGN PATENT DOCUMENTS

| | | |
|---|---|---|
| 14559 | 5/1932 | Denmark . |
| 357005 | 10/1961 | Switzerland . |

*Primary Examiner*—John F. Terapane
*Assistant Examiner*—T. J. Wallen
*Attorney, Agent, or Firm*—Finnegan, Henderson, Farabow, Garrett & Dunner

[57] ABSTRACT

A fragment warhead including an explosive divided into a plurality of axially adjacent segments by detonation wave barriers. At least one detonator is embedded in each segment. A fragmentation layer encases the explosive, and a fuze selectively activates at least one detonator in each segment to generate a fragment pattern having selected width and angular direction.

17 Claims, 15 Drawing Figures

SELECTABLE INITIATION-POINT FRAGMENT WARHEAD

BACKGROUND OF THE INVENTION

1. Field of the Invention

This invention relates to fragment warheads, in particular, selectable initiation-point warheads generating directed fragment patterns.

2. Description of Related Art

Non-nuclear warheads kill a target by fragment impact. Symmetrical warheads with single point initiation systems generate a fixed, isotropic fragment distribution. Since a target, particularly an airborne target, generally occupies only a small portion of the area of fragment distribution, such warheads are inefficient kill mechanisms.

Many efforts have been made to improve warhead kill efficiency by directing the fragment pattern on detonation. These efforts have included mechanical reorientation of the warhead just prior to detonation, the use of shaped explosives or fragment casings, and the use of complex detonation and fuzing systems.

Examples of previous efforts are discussed in U.S. Pat. Nos. 3,447,463; 3,598,051; 3,703,865; 3,796,158; 3,820,462; 3,960,085; and 3,978,796.

One prior effort is represented by U.S. Pat. No. 3,853,059 to Moe, which teaches a double-end initiation system. In such a system, a cylindrical explosive includes a detonator at each axial end thereof. Selective initiation of one detonator generates an isotropic conical fragment pattern and initiation of both detonators simultaneously generates an isotropic annular disc fragment patterns.

Each effort at developing a warhead having directed or aimable fragments has had certain drawbacks. The most common detriment of these prior systems has been the necessarily large size and/or weight of the system. Increased size or weight of a warhead system decreases the usable fragment volume and the weight and volume of explosives. For example, many known methods require fuzing systems which identify azimuthal direction to the target. Such systems are complex, heavy and voluminous.

Additionally, due to detonator safety requirements, many known devices include elaborate multiple detonator arrays incorporating complex safe-arming mechanisms. Most detonators require a mechanical barrier to be interposed between the detonator and the explosive to be detonated (also called the "main charge") for safety reasons; the weight and volume of the mechanical barrier and the mechanism rendering the barrier selectively removable detract from the available explosive and fragment content of the weapon system. See, for example, Moe, U.S. Pat. No. 3,853,059.

Many known detonators involve use of mechanical safe-arm devices in conjunction with a hot bridge wire or an exploding bridge wire generating single-point initiation. Where multipoint initiation is required for fraqment dispersion, multiple single-point initiation detonators were required. Each such detonator required a separate mechanical safe-arm device. This substantially increased the cost and weight of the warhead and reduced its reliability.

To overcome the drawbacks of multiple separate detonators, combined detonating fuzes (CDF) have been used. Such CDF systems incorporate a single initiator connected by CDF to multiple boosters. See Moe, U.S. Pat. No. 3,853,059. Simultaneous or sequential detonation requires careful design of CDF connections, since the length of the fuze determines time of booster detonation. Again, the cost and weight of such a system is great and its reliability is a problem.

One recent development, as described in Coltharp, U.S. Pat. No. 4,334,474, improves upon the CDF system by providing simultaneous multi-point initiation along a line or over surface. Instead of using connecting fuze material, the system in Coltharp uses a mesh of exploding bridge wires which simultaneously detonate a secondary explosive, namely PETN, along a line or surface. The system in Coltharp, therefore, provides for simultaneous multi-point initiation but does not permit sequential multi-point initiation absent the use of a plurality of mesh initiators.

A more significant disadvantage in the Coltharp device is its use of PETN as the booster for the detonator. Known detonators make use of primary or secondary explosives as boosters. The primary explosive is more volatile than the secondary explosive and requires significant safety protections to avoid inadvertent detonation. Even where certain secondary explosives are used as boosters in a detonator, the level of volatility of these explosives requires the use of mechanical barriers between the detonator and the main explosive charge as a safety precaution against accidental detonation. Pursuant to Mil-Std-1316, PETN, although a secondary explosive, requires a mechanical barrier between it and the main charge. Thus, the device in Coltharp has the additional disadvantage of requiring the mechanical safe-arm structure not necessary in the subject invention.

The present invention provides a warhead having precise initiation point detonation which is capable of directing the fragmentation pattern to maximize the number and energy of fragments impacting a target. The unique structure of the invention, however, minimizes the drawbacks of conventional systems. The elimination of mechanical safe-arm devices greatly simplifies the warhead and makes it cheaper and lighter. The warhead of the invention, therefore, results in a higher kill probability for an interceptor system having a given warhead weight.

SUMMARY OF THE INVENTION

The objects and advantages of the invention may be realized and obtained by means the instrumentalities and combinations particularly pointed out in the appended claims.

In accordance with the invention, as embodied and broadly described herein, a fragment warhead comprises an explosive formed into a shape having a longitudinal axis, barrier means dividing the explosive into a plurality of axially adjacent segments for delaying axial movement of detonation waves between segments, at least one independent detonator imbedded in each segment, a fragmentation layer coaxially encasing the periphery of the explosive, and fuze means for sensing a target and for selectively activating at least one detonator in each segment to generate a fragment pattern having a selected width and angular direction.

Preferably, the explosive is cylindrical and formed of a plurality of axially adjacent segments with barrier means located coaxially between adjacent segments.

Preferably, at least two detonators are embedded in each segment without a mechanical safe-arm device and disposed in spaced relationship. In a preferred embodiment, two or more detonators are joined in spaced relationship by an electrical conduit forming a detonator string structure, at least one detonator string structure being embedded within each segment.

The preferred detonator is a high energy initiator not requiring a mechanical safe-arm device, such as an exploding foil initiator.

Preferably, the barrier means comprises a detonation wave barrier of inert material coaxially disposed between adjacent segments. In one embodiment, the barrier comprises alternating layers of low and high shock impedance material.

The preferred fragmentation layer is a layer of preformed fragments which, in some embodiments, may include additional explosive for generating low velocity disc fragment patterns.

The means for selectively activating the detonators may comprise any fuze means capable of sensing the relative target trajectory and signal processing means for selectively activating detonators in a selected sequence to generate an aimed fragment pattern. In a preferred embodiment, a dual beam fuze which senses and generates an electrical signal representing target miss distance and crossing angle is used in conjunction with signal processing means electrically connected to detonators for activating selected detonators in a selected sequence to generate a fragment pattern having a selected width and angular direction.

BRIEF DESCRIPTION OF THE DRAWINGS

The accompanying drawings, which are incorporated in and constitute a part of the specification, illustrate embodiments of the invention and together with a description, serve to explain the principles of the invention.

DETAILED DESCRIPTION OF THE PREFERRED EMBODIMENTS

Figure 1:
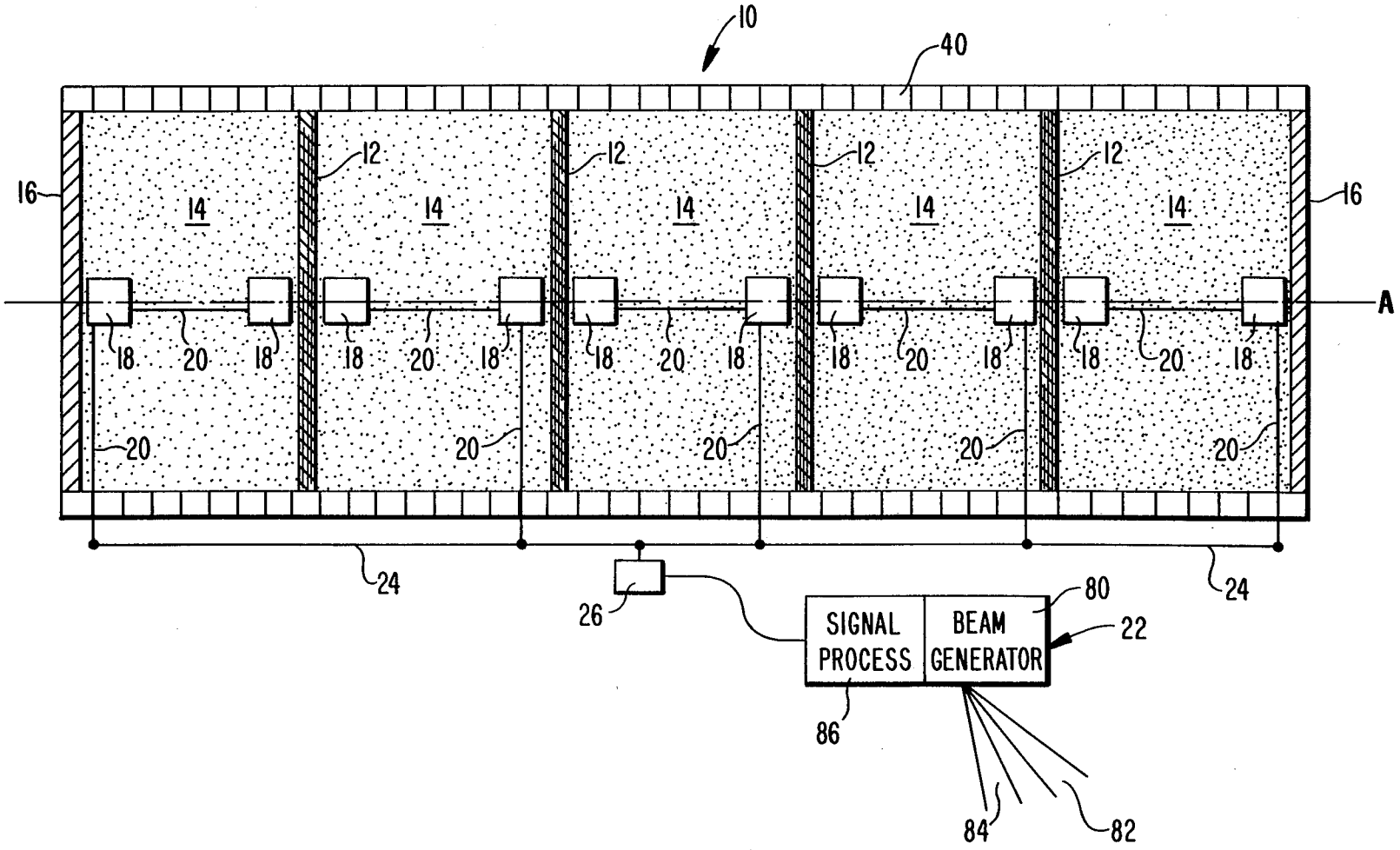
FIG. 1 is a longitudinal cross section of the warhead of the invention.

Reference will now be made in detail to the present preferred embodiments of the invention, examples of which are illustrated in the accompanying drawings.

Fragment warheads must have at least three basic elements: fragments, an explosive and detonators. These elements in the warhead of this invention not only are constructed and arranged in unique ways, but the warhead also includes additional elements as set forth below to provide certain of the advantages of this invention.

The fragment warhead of the invention comprises an explosive having a longitudinal axis including a plurality of segments of explosive being disposed coaxially adjacent each other. In the embodiment depicted in FIG. 1, the fragment warhead 10 comprises an assembly having longitudinal axis A formed of identical coaxially adjacent explosive segments 14. Each segment 14 is formed in a preselected shape by casting or as well as other methods, such as welding or pressing. While segments 14 may be formed in many different shapes, preferably they are formed as a cylinder and the warhead assumes a cylindrical shape as the segments are assembled. Many known explosive materials may be used for explosive 10.

In accordance with the invention, the warhead comprises a plurality of independent detonators, at least one detonator being imbedded or cast in each segment. While a mechanical safe-arm device could be placed between the detonator and the explosive, preferrably the detonator used does not require a mechanical safe-arm device. By eliminating the mechanical safe-arm device, the warhead is greatly simplified, is less expensive and is lighter. More importantly, elimination of the mechanical safearm device makes it possible to produce a warhead having a detonation propagation pattern which proceeds exactly as designed for maximal effect.

The detonator contemplated by the subject invention is an exploding foil initiator (EFI) of the type manufactured by Reynolds Industries, Inc. This detonator uses HNS explosive in both its initiator and in its output booster. According to Mil-Std-1316, no mechanical barrier is required between the EFI detonator and the warhead main charge. Since the EFI detonator need not be separated from the warhead main charge by a mechanical barrier, that detonator, other detonators not requiring a separating mechanical safe-arm device, may be imbedded within the explosive. Thus, in accordance with the invention, the detonators 18 are cast into segments 14 of the explosive.

Another advantage of the EFI detonators is that they may be connected along a single stripline lead. Thus, where a plurality of detonators are required in a particular cast explosive, a selected number of EFI detonators may be physically interconnected with a selected spacing along a single electrical cable or stripline and cast into the segments of the warhead's main charge since the EFI detonators do not require a mechanical barrier between the explosive and the detonator. In this way, the detonator positions are preformed along a stripline, and the steps involved in the manufacture of cast explosives with detonators imbedded therein are substantially reduced. Reliability of the detonators is further enhanced by the pre-manufactured interconnection. Furthermore, the complexity of the overall warhead is substantially reduced in that the complexity of the electrical system for initiating the detonators is reduced. It has been determined that up to ten EFI detonators on a stripline may be simultaneously initiated by one charged capacitor.

Although reference has been made to the use of EFI detonators, other detonators having the same advantages may be used for the purposes of this invention.

Preferably, a selected number of EFI detonators 18 are disposed on upon a prefabricated cable or stripline 20, and the entire stripline 20 with detonators 18 are cast within the explosive segment 14 so that the initiation points are at the required locations. The exact number of detonators per stripline and the exact number and location of detonators in the warhead is a function of the particular warhead design that utilizes the invention. A plurality of separate striplines of detonators may be used in the same warhead and alternately or sequentially selected by the warhead fuzing system.

Preferably, the warhead of the invention comprises a string of at least two detonators 18 per segment 14. The location of the detonators in each segment depends upon the desired fragmentation pattern and other warhead characteristics. In the embodiment depicted in FIG. 1, the detonators 18 are disposed along axis A of the warhead and a pair of detonators 18 are disposed in each segment, one of the pair being disposed adjacent each axial end of each segment.

Cable or stripline 20 interconnects each detonator 18 in a segment 14. Each stripline 20 is connected to a fuze system 22 through an electrical conduit 24 and connection box 26.

Figure 2:
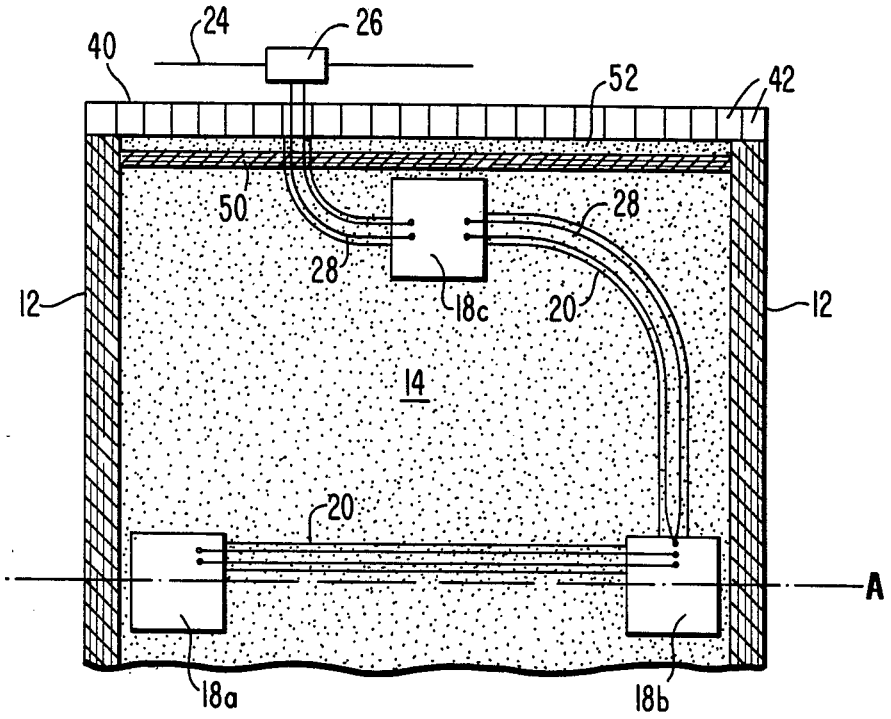
FIG. 2 is an enlarged, partial longitudinal cross section of an embodiment of the invention.

In FIG. 2, detonators 18*a*, 18*b*, 18*c* on a stripline or cable 20 are electrically connected to connection box 26 and fuze system 22 by electrical conduit means 28 in each cable 20. Any known method of electrical connection may be used to provide independent electrical initiation of each detonator.

With the present invention, the fragmentation pattern of the warhead can be formed in different ways, some of which involve sequential detonation of different segments. When adjacent segments of explosive need to be detonated at different times, the detonation wave from the earlier detonated explosive segments must be prevented from detonating and delayed from destroying the adjacent, later-detonated segments. A detonation wave barrier, therefore, must be disposed between adjacent segments.

In accordance with the invention, barrier means dividing the explosive into a plurality of coaxially adjacent segments delays axial movement of detonation waves between segments.

As depicted in FIG. 1, barrier means 12 divides the explosive of warhead 10 into a plurality of axially adjacent segments 14. The detonation wave barrier in the present invention is designed to delay sympathetic detonation of adjacent segments, and also delay substantial deformation or destruction of those adjacent segments until they are detonated by their independant detonators. Furthermore, the barrier must be lightweight and compact to minimize the effect on explosive packaging efficiency provided by the invention.

Known detonation wave barriers include air gaps or low density inert material of the type used in wave shaping, or include heavy metal containment of the type used to protect adjacent components in munitions. Air gaps or low density inert materials by themselves, require excessive volume to delay the effect of a detonation wave for a specific time period. Air gaps and low density inert material are also not resistant to handling and operational shock. Metal containment barriers are undesirable since they must be excessively thick and heavy in order to prevent a detonation from initiating detonation in an adjacent segment.

Figure 3:
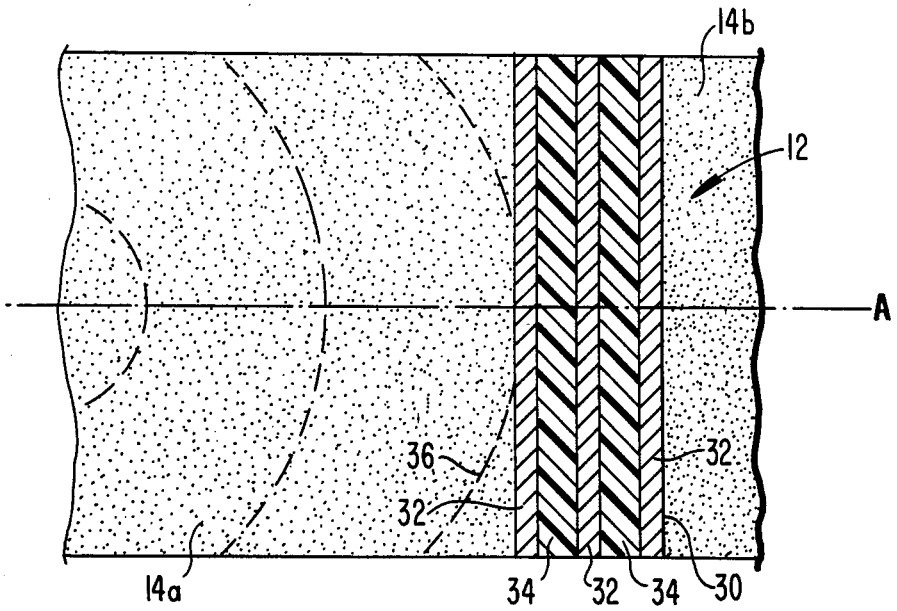
FIG. 3 is an enlarged, partial longitudinal cross section of an embodiment of the invention.

Preferably, as depicted in FIG. 3, the barrier means of this invention, shown by way of example as barrier means 12 in FIG. 1, comprises a detonation wave barrier 30 disposed normal to axis A. Detonation wave barrier 30 includes axially adjacent, alternating layers of high and low shock impedance material. Layers 32 of high shock impedance material are axially adjacent and alternating with layers 34 of low shock impedance material. Preferably, layers 32 and 34 are composed of lightweight shock impedance material such as aluminum for layers 32 and a plastic, such as Plexiglas, for layers 34.

The detonation wave barrier 30 may consist of any number of alternating layers; preferably a high shock impedance layer 32 is immediately adjacent the explosive. Thus, as seen in FIG. 3, wave barrier 30 consists of five layers and is bi-directional such that detonation of either explosive segment 14*a*, 14*b* will not cause detonation or substantial deformation of the axially adjacent explosive segment.

When explosive segment 14*a* is detonated, a detonation wave 36 is generated. Wave 36 impinges high shock impedance layer 32 and is partially reflected into explosive 14*a* enhancing the detonation. Part of the detonation wave is also transmitted to low shock impedance layer 34. The intensity of the shock transmitted to low impedance layer 34 is below the initial detonation shock level of the explosive. The reflection/transmission attenuation of the first two layers 32, 34 is repeated in the third and fourth layer 32, 34 and additional pairs of layers if included.

Where the shock intensity transmitted to the axially adjacent segment 14*b* is below the detonation threshold, no detonation will be initiated by the shock transmission. There will be a gradual compression of the explosive in segment 14*b* as the internal reflections in the wave barrier 30 allow the stress in each layer 32, 34 to equalize. The multiple internal reflections provide a longer path than a single material and, therefore, a longer delay before explosive segment 14*b* is distorted by the adjacent detonation. The number of layers in the wave barrier 30 may be adjusted for the attenuation and delay required.

In addition to the barrier means, the fragmentation pattern of the warhead is also determined by the arrangement of material surrounding the explosive. In accordance with the invention, the warhead also includes a fragmentation layer encasing the explosive. As seen in FIG. 1, fragmentation layer 40 encases explosive segments 14. Where the explosive is shaped as a cylinder, the fragmentation layer will be cylindrical and concentric with the explosive. Preferably, the fragmentation layer is formed of preformed fragment such as taught in Brumfield, et al., U.S. Pat. No. 3,977,327. The fragmentation layer may also be a metal sheet which is scored to define the fragment shapes.

Figure 4:
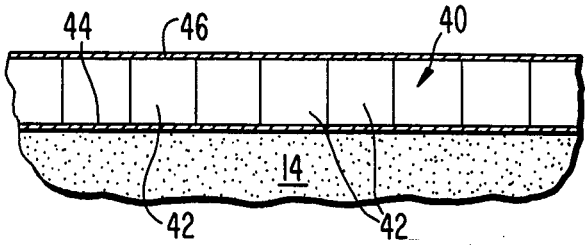
FIG. 4 is an enlarged part of the embodiment depicted in FIG. 1.

Referring to FIG. 4, the fragmentation layer 40 preferably includes a plurality of preformed fragments 42 arranged to define inside and outside surfaces. Each of the inside and outside surfaces of the fragmentation layer 40 are covered with retention layers 44 and 46, respectively, for retaining the preformed fragments 42 in position prior to detonation. Preferably the retention layers 44, 46 are thin layers of aluminum.

In designing a fragmentation layer to generate a particular fragment pattern, consideration must be given not only to the relative trajectory of the target, but also to the closing velocity of the target. This is significant in terms of the speed and shape of the detonation pattern generated when the warhead is detonated. Where a cylindrical preformed fragmentation layer encases cylindrically configured explosive, as depicted in FIG. 1, detonation of the explosive deploys fragment with a relatively high velocity, 4,000–8,000 feet per second (fps), in an expanding donut shaped pattern that impacts the target as it passes the interceptor. Such a high speed fragment pattern is useful against targets having low relative closing velocities, less than 15–20,000 fps. For targets having high relative closing velocities, a slowly expanding disc of fragments deployed about the relative velocity vector is necessary. In such a disc pattern, fragments are deployed at a low velocity (20–1,000 fps).

Most known warheads have been designed for either intercepting targets with high relative closing velocities or low relative closing velocities. One embodiment of the subject invention provides a single warhead capable of generating fragment patterns for intercepting targets over a wide range of relative velocities, including velocities above and below 15,000–20,000 feet per second. A warhead having such a combination of features would be useful in endo-atmospheric ballistic missile interceptors with altitude requirements of 5,000–150,000 feet, and in space defense missile systems that intercept at co-orbital or anti-co-orbital velocities.

Figure 5:
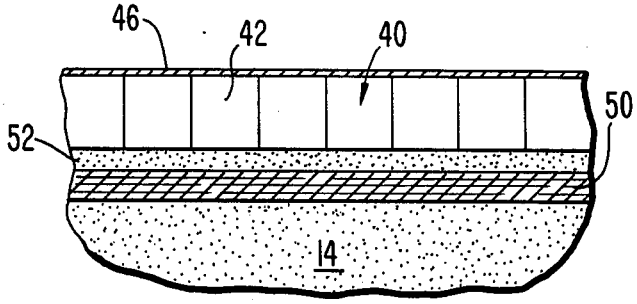
FIG. 5 is an enlarged part of the longitudinal cross section of another embodiment of the invention.

Accordingly, in an embodiment of the subject invention shown in FIG. 5, the preformed fragmentation layer 40 includes an annular detonation wave barrier 50 disposed between the explosive in segment 14 and fragments 42. The fragmentation layer also includes an annular explosive layer 52 disposed between the annular detonation wave barrier 50 and fragments 42. Means are provided for detonating annular explosive layer 52 independently of explosives in the axially adjacent segments 14. As seen in FIG. 2, detonator 18*c* is disposed adjacent annular detonation wave barrier 50 for selective detonation of annular explosive layer 52.

The small amount of explosive in the annular explosive layer 52 provides a low charge (C) to metal (M) ratio, C/M, to provide a low velocity fragment disc pattern for intercepting targets having high relative closing velocities. By combining the fragmentation layer 40 of FIG. 5 with the warhead depicted in FIG. 1, the warhead may be used to intercept high closing velocity targets for which annular explosive layer 52 is detonated, and to intercept low relative closing velocity targets for which detonators 18 along the axis of the warhead may be used to generate a high velocity fragment pattern.

In the embodiment shown, the annular wave barrier 50 prevents initiation of the main charge in segments 14 while permitting detonation of annular explosive layer 52 to generate a low velocity disc pattern.

Figure 6:
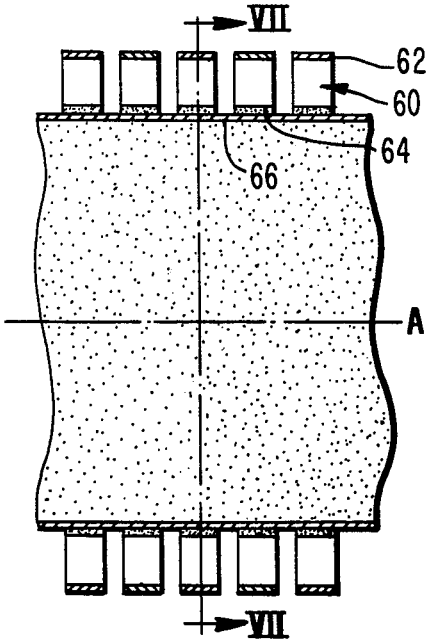
FIG. 6 is a partial longitudinal cross section of an embodiment of the invention.
Figure 7:
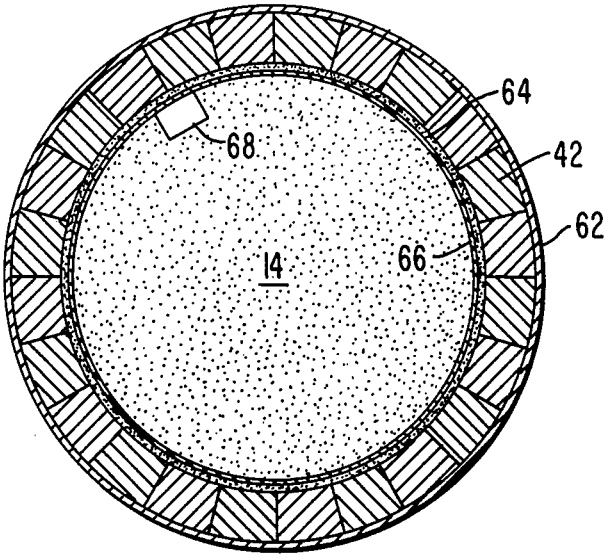
FIG. 7 is a transverse section taken along lines VII—VII in FIG. 6.

In another embodiment, seen in FIGS. 6 and 7, fragmentation layer 40 comprises a plurality of axially adjacent annular rings 60 of preformed fragments, a retaining band 62 encompassing the outside surface of each ring 60, an annular explosive band 64 disposed between each ring 60 and the explosive in the main charge of the warhead, and an annular detonation wave barrier 66 between annular explosive band 64 and the explosive segments 14 of the warhead. Means are also provided for detonating annular explosive band 64 independently of explosive 14. For example, as seen in FIG. 7, detonator 68 is disposed adjacent annular wave barrier 66 for detonating annular explosive band 64 to provide a low velocity fragment pattern. One detonator 68 may be used per annular ring 60, or one detonator 68 in conjunction with a plurality of boosters may be used for simultaneously initiating annular explosive layers 64 in several rings 60.

Figure 8:
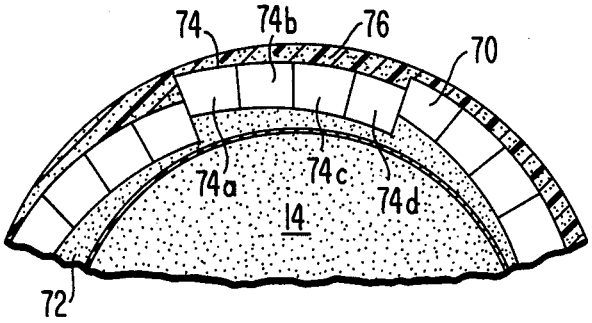
FIG. 8 is a partial transverse cross section of an embodiment of the invention.

Various low velocity disc patterns may be formed by varying the amount of explosive used to generate the fragment pattern between axially adjacent rings or by varying the timing of the initiation of the annular explosive bands on axially adjacent rings. For example, in FIG. 8, annular ring 70 includes several segment sections like section 74 which diverge from the circumference of the warhead explosive 14. This construction provides an unequal distribution of annular explosive 72 under individual segments 74*a–d*. Thus, the variable C/M ratio allows initiation of explosive 72 to provide a shaped low velocity fragment pattern. In the embodiment of FIG. 8, the outside surface of ring 70 is covered with a foam retaining substance 76 which forms itself to the uneven surface of the ring 70.

Figure 9:
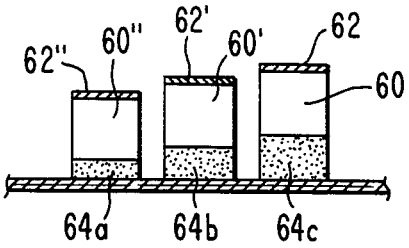
FIG. 9 is a partial longitudinal cross section of an embodiment of the invention.

An alternate embodiment of the warhead of this invention is depicted by the diagram of a partial longitudinal cross section shown in FIG. 9. Annular ring 60 has a different amount of explosive in layer 64 than are in layers 64*a* and 64*b* in axially adjacent annular rings 60′ and 60″ thereby providing varying C/M ratios along the length of the warhead. Simultaneous initiation of all annular explosive bands 60, 60′ and 60″ will provide different deployment velocities to fragments 62, 62′ and 62″ thus generating a desired shaped fragment pattern.

Figure 10:
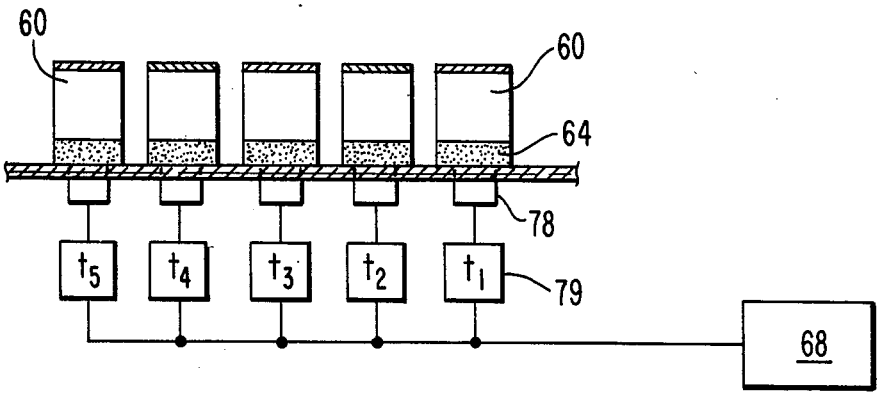
FIG. 10 is a partial longitudinal cross section of an embodiment of the invention.

In another embodiment of this invention, as shown in FIG. 10, each axially adjacent fragment ring 60 will have an equal amount of annular explosive in bands 64, however, each annular ring 60 is provided with a booster 78 connected to a detonator 68 via individual timers 79. The timers 79 provide variable delays between activation of detonator 68 and activation of boosters 78. This arrangement provides timed initiation of individual annular fragment rings 60.

Figure 11:
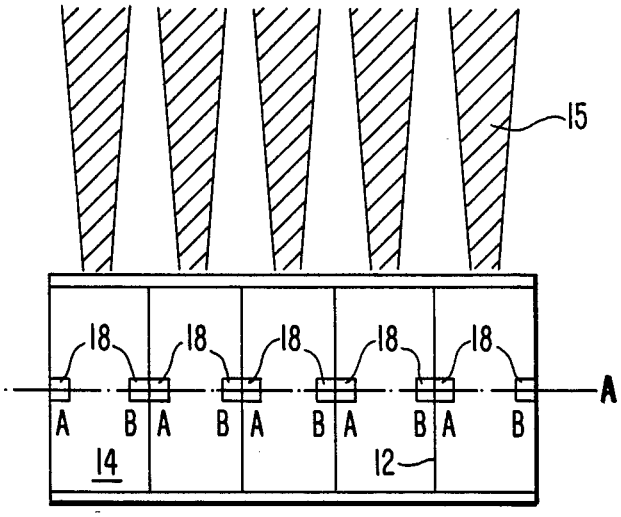
FIGS. 11, 12, 13 are diagrammatic depictions of fragment patterns of the embodiment of invention depicted in FIG. 1.
Figure 12:
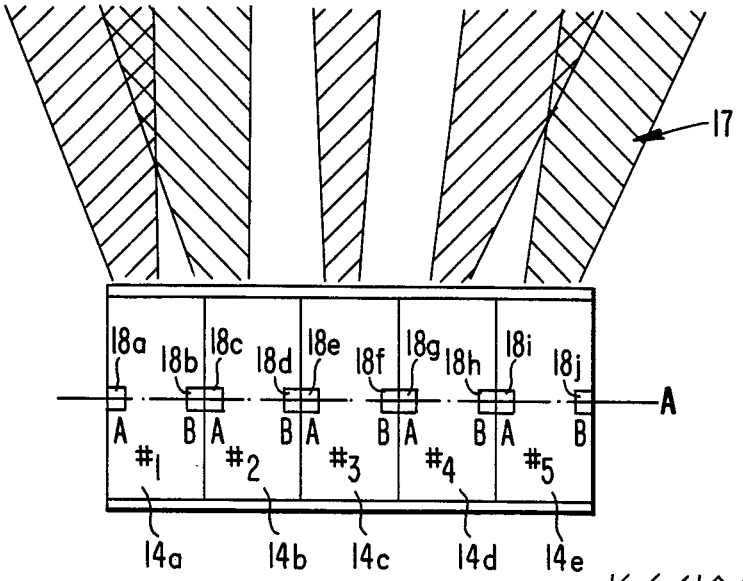
Figure 13:
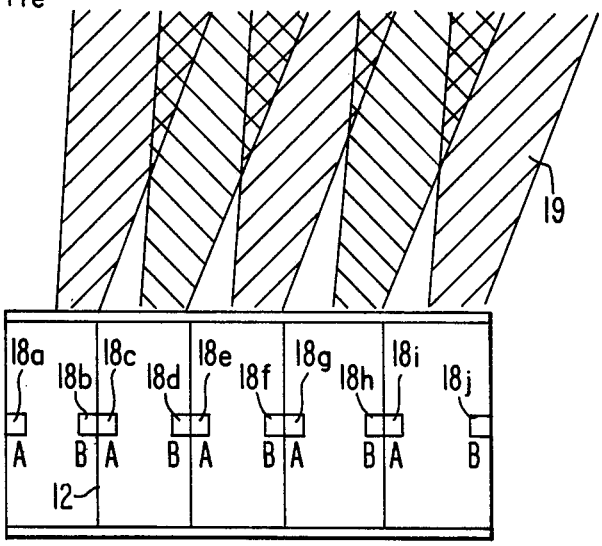

The warhead depicted in FIG. 1 may also be selectively detonated to generate varying fragment patterns depending upon the target miss distance, which is defined as the distance between the target and the warhead, and crossing angle, which is defined by the angle between the paths of the target and warhead. These values are sensed by the fuze 22, as is discussed below. The fragmentation patterns shown in FIGS. 11–13 are for high velocity fragments but also could be generated for low velocity fragments according to the procedures and devices discussed relative to FIGS. 4–10. While the number of segments 14 and number of detonators 18 per segment 14 are a function of the warhead pattern control requirements and may be varied, various fragment patterns may be generated by the warhead arrangement as depicted in FIG. 1. Generally, the fragment patterns are generated to maximize the chances of or kill by increasing the number of fragments aimed to intercept the target.

For example, where the target miss distance is large and there is a low crossing angle, all detonators 18 should be simultaneously initated resulting in simultaneous double-end initiation of each segment 14 and generating narrow beams 15 of fragments in a direction perpendicular to axis A as shown in FIG. 11. On the other hand, as seen in FIG. 12, where the target has a close miss distance and a low crossing angle, the signal processor will simultaneously detonate detonators 18*b*, 18*d*, 18*e*, 18*f*, 18*g* and 18*i*. Such a detonation results in double end initiation of segment 14*c* and single end initiation to the other segments. This results in a wide beam pattern 17 as seen in FIG. 12.

Where, for example, target miss distance is large and there is a large crossing angle, the signal processor should activate detonators 18*a*, 18*c*, 18*e*, 18*g*, and 18*i* to form a fragment pattern 19 which is directed away from each of the initated detonators as may be seen in FIG. 13.

The selection of detonators is, of course, dependent upon end game analysis and fuze logic. The warhead of the invention may be used in missile systems in which, for some intercept/target combinations, a large fuze error is expected. Where a large fuze uncertainty is expected and high target velocities are encountered, a wide fragment pattern 17 as depicted in FIG. 12 may be spread further by firing detonators 18*e* and 18*f* simultaneously then, after a short delay, firing detonators 18*d* and 18*g* and then, again after a short delay, firing detonators 18*b* and 18*i*. Another fragmentation pattern which may be generated where large fuze uncertainties and high target velocities are involved can be achieved by detonating in a timed sequence the detonators on the same side of adjacent segments (i.e., 18*a*, 18*c*, 18*e*, 18*g* and 18*i* or 18*b*, 18*d*, 18*f*, 18*h* and 18*j*).

To provide the different fragmentation patterns for different targets, some capability must exist for determining certain information about the targets. In accordance with the invention, the warhead includes fuze means for sensing a target and for selectively activating at least one detonator in each segment to generate a fragment pattern having a selected width and angular direction.

Known warheads having directional fragment patterns have included a fuze system for determining target location in an angular zone measured around the missile circumference. This type of fuze usually incorporates a series of circumferential antennae and relies on reception of target echo signals in one antenna sector only.

The fuze means of the invention also includes signal processing means 86 for determining target miss distance and target crossing angle to axis A and for selectively actuating selected detonators to generate a fragment pattern directed for optimum target intercept.

Figure 14:
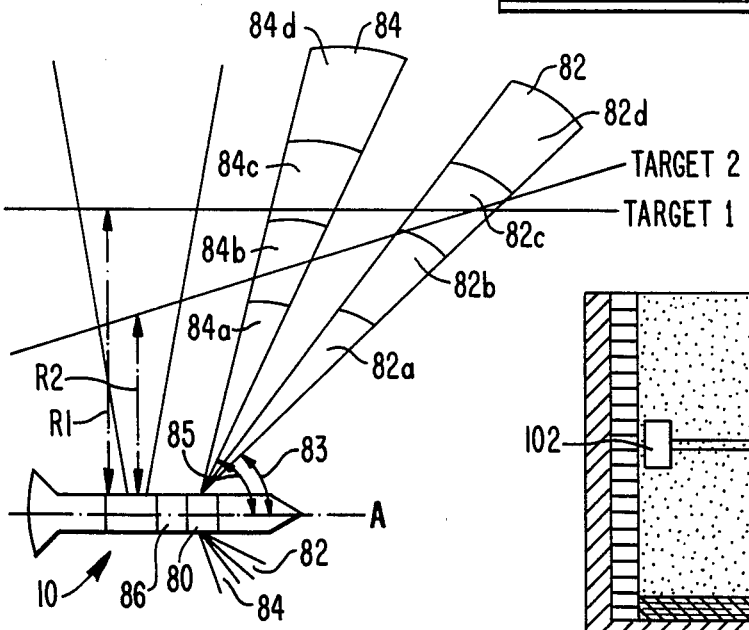
FIG. 14 is a diagrammatic representation of part of the invention in operation.

The preferred embodiment of the subject invention, as depicted in FIGS. 1 and 14 includes means for generating at least two conical beams concentric with the explosive's longitudinal axis. In FIGS. 1 and 14, the beam generating means includes generator 80. Each conical detection beam 82, 84, shown in FIG. 14, is generated at a different predetermined angle to longitudinal axis A. As depicted in FIG. 14, beam 82's angle relative to axis A represented by arrow 83 and beam 84's angle relative to axis A is represented by arrow 85. Each beam 82, 84 also includes a plurality of range gates 82*a*, 82*b*, 82*c*, 82*d* and 84*a*, 84*b*, 84*c*, 84*d*, respectively, at predetermined distances from warhead 10. Each range gate defines a set of ranges or distance relative to warhead 10.

In a preferred embodiment, the generator 80 is a leading edge detection dual-beam fuze of the type currently in use by the U.S. Navy under the designation MARK-45. This Mark-45 system uses a bi-conical dual-beam to distinguish between large and small targets and measures target range by the use of range gates. Use of this fuze in a missile directed against ballistic missile targets, either intercontinental or medium range, would not be effective since the signal processing for the Mark-45 fuze would sense all such ballistic missiles as small targets. In the subject invention, however, the signal processor of the Mark-45 fuze is replaced with electronic logic elements and software which may be developed by anyone skilled in the art for determining target miss distance and target crossing angle to the axis, from the data obtainable by the dual conical beams generated by the fuze.

As seen in FIG. 14, target 1 passes through range gates 82*c* and 84*c*. Generator 80 detects this information which signal processor 86 then uses to determine that target 1 has a small crossing angle relative to axis A and to determine miss distance R1 of target 1. Target 2 in FIG. 14 crosses range gates 82*c* and 84*b*. Generator 80 detects this information which is used by the signal processor 86 to determine the relative crossing angle to axis A and the miss distance R2 for target 2.

With the information from generator 80 and signal processor 86, the warhead of this invention can generate the appropriate fragmentation pattern for the different targets.

If the warhead of the invention incorporates fragmentation layer as depicted in FIG. 5 for generating a low velocity fragment pattern to intercept targets having high relative closing velocities in addition to the detonation pattern depicted in FIGS. 11–13, the fuze means preferably includes signal processing means for determining the time of target intercept of, e.g., beams 82 and 84, as well as the particular range gates intercepted by the target to determine the relative target speed in addition to target miss distance and crossing angle. The target speed relative to the warhead indicates which detonators and explosives to use. In this embodiment, the signal processing means includes means for selectively actuating certain detonators, for example detonators 18 in FIG. 1, when relative target speed is less than a predetermined value and for actuating other detonators, such as detonator 68 in FIG. 7, to generate a low speed fragment pattern when relative target speed is greater than the predetermined value. Thus a single warhead can, with the present invention, be manufactured for use with intercepting different types of targets.

The warhead of the invention may be assembled by a method including the step of disposing in a mold a stripline lead including a plurality of detonators fixed thereto at predetermined positions, the stripline lead being arranged to place the detonators in selected positions. As embodied herein and depicted in FIG. 15, stripline lead 100, including detonators 102 fixed thereto at predetermined positions, is disposed within mold 110 to place detonators 102 at selected positions.

Figure 15:
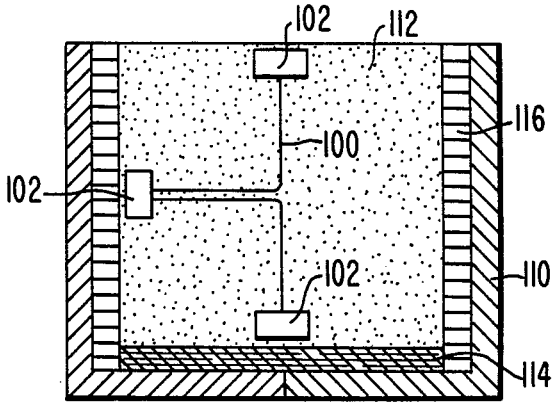
FIG. 15 is a cross section of explosive without a mechanical safearm device.

The method of the invention further comprises casting explosive in the mold to embed the detonators in the explosive without a mechanical safe-arm device between the detonators and the explosive. As seen in FIG. 15, explosive 112 is cast within mold 110 embedding detonators 102 and stripline 100 within the explosive without a mechanical safe-arm device between the detonators 102 and explosive 112.

Preferably, the method further includes, before casting the explosive, the step of disposing at one end of mold 110 detonation wave barrier 114 and lining the periphery of mold 110 with fragmentation layer 116.

After preparation of individual cast segments, the segments are axially aligned, the detonators wired into the fuze and the retaining layer disposed on the outside surface of the fragment layers to hold the fragments in place.

It will be apparent to those skilled in the art that various modifications and variations could be made to the warhead of the invention without departing from the scope or spirit of the invention.

What is claimed is:

1. A fragment warhead, comprising:

an explosive formed into a shape having a longitudinal axis;

barrier means dividing said explosive into a plurality of axially adjacent segments for delaying propagation of detonation waves between segments;

at least two detonators embedded in spaced relation in each said segment;

a fragmentation layer encasing said explosive; and fuze means for sensing a target and for activating at least one said detonator in each said segment in a selected sequence to generate a fragment pattern having a width and angular direction selected in response to the sensed relative position of said target.

2. The warhead of claim 1 wherein said explosive is cylindrical in shape and is formed of a plurality of axially adjacent segments of explosive and wherein said barrier means is disposed between adjacent segments.

3. The warhead of claim 2 wherein said detonators are disposed along said axis and wherein one of the pair of detonators disposed in each said segment is located adjacent each axial end of said segment.

4. The warhead of claim 2, wherein said detonators are cast in each said segment and all the detonators in one segment are physically interconnected by electrical cable at predetermined spacing and cast in said segment at predetermined locations.

5. The warhead of claim 4 including electrical conduit means in said cable for electrically connecting each said detonator on said cable independent of the other detonators on said cable.

6. The warhead of claim 1, 3, 4, or 5 wherein each said detonator is embedded in the explosive without a mechanical safearm device separating the detonator from the explosive.

7. The warhead of claim 1, 3, 4, or 5 wherein said detonator includes initiators and boosters using HNS explosive.

8. The warhead of claim 1, 3, 4, or 5 wherein said detonators are exploding foil initiators.

9. The warhead of claim 1 wherein said fragmentation layer is a layer of preformed fragments.

10. The warhead of claim 1 wherein said fragmentation layer is a scored metal layer.

11. The warhead of claim 9 also including retention layers covering the inside and outside surfaces of said fragmentation layer for retaining said preformed fragments in position prior to detonation.

12. The warhead of claim 13 wherein said retention layers are thin layers of aluminum.

13. The warhead of claim 9 also including an annular detonation wave barrier disposed between said explosive and said fragments, an annular explosive layer disposed between said annular detonation wave barrier and said fragments, and means for detonating said annular explosive layer independently of said explosive.

14. The warhead of claim 1 wherein said fragmentation layer comprises a plurality of axially adjacent annular rings of preformed fragments, a retaining band encompassing the outside of each said ring, an annular explosive band between each said ring and said explosive, an annular detonation wave barrier between said annular explosive bands and said explosive, and means for detonating said annular explosive bands independently of said explosive.

15. The warhead of claim 1 wherein said fuze means comprises means for sensing and generating an electrical signal representing target miss distance and target crossing angle to said axis and for activating selected detonators in a selected sequence to generate a fragment pattern directed for optimum target intercept.

16. The warhead of claim 13 or 14 wherein said fuze means comprises means for sensing and generating an electrical signal representing target miss distance, target crossing angle relative to said axis and relative target speed, for selectively actuating selected detonators when relative target speed is less than a predetermined value and for selectively actuating said detonating means when relative target speed is greater than said predetermined value.

17. The warhead of claim 1 wherein said fuze means comprises:

means for generating at least two conical beams concentric with said axis, each said beam being at a different, predetermined angle to said axis and including a plurality of range gates at predetermined distances from said warhead, and signal processing means for determining target miss distance and target crossing angle relative to said axis and for selectively actuating selected detonators to generate a fragment pattern directed for optimum target intercept.

* * * * *